US007802335B2

(12) United States Patent
Hoppe et al.

(10) Patent No.: US 7,802,335 B2
(45) Date of Patent: Sep. 28, 2010

(54) BULK DISPENSE USER ADJUSTABLE CONTROLS

(75) Inventors: Christopher Hoppe, Louisville, KY (US); Craig R. Vitan, Louisville, KY (US); Ashley Burt, Louisville, KY (US); John Schuckmann, Louisville, KY (US); Steven Recio, Louisville, KY (US); Carl Risen, Louisville, KY (US); John M. Todd, Louisville, KY (US); Keerthi Vasan, Pondicherry (IN)

(73) Assignee: General Electric Company, Schenectady, NY (US)

( * ) Notice: Subject to any disclaimer, the term of this patent is extended or adjusted under 35 U.S.C. 154(b) by 366 days.

(21) Appl. No.: 11/871,750

(22) Filed: Oct. 12, 2007

(65) Prior Publication Data

US 2009/0095028 A1 Apr. 16, 2009

(51) Int. Cl.
*D06F 39/02* (2006.01)

(52) U.S. Cl. ..... 8/158; 68/17 R; 68/207

(58) Field of Classification Search ..... 68/17 R, 68/207; 8/158
See application file for complete search history.

(56) References Cited

U.S. PATENT DOCUMENTS

| | | | | |
|---|---|---|---|---|
| 2,699,886 | A | 1/1955 | James | |
| 2,946,489 | A | 7/1960 | Brucken | |
| 3,013,568 | A | 12/1961 | Getchell et al. | |
| 3,045,876 | A * | 7/1962 | Marchi | 222/386 |
| 3,107,824 | A | 10/1963 | Perl | |
| 3,124,271 | A * | 3/1964 | Beck | 222/644 |
| 3,289,896 | A | 12/1966 | Cushing | |
| 3,402,853 | A | 9/1968 | Perl | |
| 3,595,036 | A | 7/1971 | DePas | |
| 3,608,514 | A | 9/1971 | Dunn | |
| 3,611,456 | A * | 10/1971 | Hildebrandt | 8/149.1 |
| 3,826,113 | A | 7/1974 | Boraas et al. | |
| 3,827,600 | A | 8/1974 | Janke | |
| 3,856,058 | A | 12/1974 | Fackler | |
| 3,896,827 | A | 7/1975 | Robinson | |

(Continued)

FOREIGN PATENT DOCUMENTS

DE 24 07 544 8/1975

(Continued)

OTHER PUBLICATIONS

European Patent Office 0 633 342 Jan. 1995.*

(Continued)

*Primary Examiner*—Frankie L Stinson
(74) *Attorney, Agent, or Firm*—Merchant & Gould P.C.

(57) ABSTRACT

Systems and methods for delivering an additive to an appliance are disclosed. The systems may include a user interface configured to accept a user input and a controller connected to the user interface. The controller may be configured to receive the user input and cause an additive delivery system to deliver at least one additive to the appliance. The methods include receiving an amount of the additive to be delivered to the appliance and receiving a time at which the additive is to be delivered to the appliance during a cycle. The method may further include activating an additive delivery system to deliver the amount of the additive at the time to the appliance.

20 Claims, 4 Drawing Sheets

U.S. PATENT DOCUMENTS

| | | | | |
|---|---|---|---|---|
| 4,009,598 | A | 3/1977 | Bernard et al. | |
| 4,063,663 | A | 12/1977 | Larson et al. | |
| 4,149,654 | A | 4/1979 | Nelson et al. | |
| 4,149,657 | A | 4/1979 | Nelson et al. | |
| RE30,097 | E * | 9/1979 | Gillespie | 68/12.08 |
| 4,213,338 | A | 7/1980 | Hardy | |
| 4,334,881 | A | 6/1982 | Reinert et al. | |
| 4,373,863 | A | 2/1983 | Mason et al. | |
| 4,488,666 | A | 12/1984 | Herbst et al. | |
| 4,756,321 | A | 7/1988 | Livingston et al. | |
| 4,830,509 | A | 5/1989 | Gulmatico, Jr. | |
| 4,845,965 | A * | 7/1989 | Copeland et al. | 68/17 R |
| 4,932,227 | A | 6/1990 | Hogrefe | |
| 5,033,659 | A | 7/1991 | Marks et al. | |
| 5,133,487 | A | 7/1992 | Russi | |
| 5,144,819 | A * | 9/1992 | Hiyama et al. | 68/12.04 |
| 5,211,188 | A | 5/1993 | Kraus | |
| 5,241,845 | A * | 9/1993 | Ishibashi et al. | 68/12.02 |
| 5,390,385 | A | 2/1995 | Beldham | |
| 5,392,618 | A | 2/1995 | Livingston et al. | |
| 5,435,157 | A | 7/1995 | Laughlin | |
| 5,560,060 | A | 10/1996 | Dausch et al. | |
| 5,603,233 | A | 2/1997 | Erickson et al. | |
| 5,647,391 | A | 7/1997 | Chan et al. | |
| 5,743,442 | A | 4/1998 | Barbe | |
| 5,758,521 | A | 6/1998 | Roberts | |
| 5,782,109 | A | 7/1998 | Spriggs et al. | |
| 5,823,390 | A | 10/1998 | Muderlak et al. | |
| 5,884,808 | A | 3/1999 | Muderlak et al. | |
| 6,012,613 | A | 1/2000 | Chen | |
| 6,095,370 | A | 8/2000 | Rhine et al. | |
| 6,152,327 | A | 11/2000 | Rhine et al. | |
| 6,293,428 | B1 | 9/2001 | Chen | |
| 6,338,351 | B1 | 1/2002 | Schrott | |
| 6,401,499 | B1 | 6/2002 | Clark et al. | |
| 6,434,977 | B1 | 8/2002 | Hapke et al. | 68/17 R |
| 6,453,917 | B1 | 9/2002 | Biechele | |
| 6,463,611 | B1 | 10/2002 | Mattla et al. | |
| 6,616,401 | B2 | 9/2003 | Nakamura | |
| 6,669,052 | B2 | 12/2003 | Barbe | |
| 6,733,252 | B2 | 5/2004 | Feygin et al. | |
| 6,792,637 | B2 | 9/2004 | Reichold et al. | 8/159 |
| 7,658,088 | B2 | 2/2010 | Walker et al. | |
| 2002/0088502 | A1 | 7/2002 | Van Rompuy et al. | |
| 2002/0117187 | A1 | 8/2002 | Helminger | |
| 2002/0153029 | A1 | 10/2002 | Cerruti et al. | |
| 2003/0127110 | A1 | 7/2003 | Reichold et al. | |
| 2003/0137264 | A1 | 7/2003 | Peterson et al. | |
| 2004/0020517 | A1 | 2/2004 | Cerruti et al. | |
| 2004/0093913 | A1 | 5/2004 | Bolduan et al. | 68/17 R |
| 2004/0226961 | A1 | 11/2004 | Mehus et al. | |
| 2004/0245284 | A1 | 12/2004 | Mehus et al. | |
| 2005/0241347 | A1 | 11/2005 | Cho et al. | |
| 2006/0117811 | A1 | 6/2006 | Kinnetz | |
| 2008/0104768 | A1 * | 5/2008 | Choi | 8/147 |
| 2008/0276965 | A1 * | 11/2008 | Aykroyd et al. | 134/18 |
| 2009/0095331 | A1 | 4/2009 | Hoppe | |
| 2009/0095750 | A1 | 4/2009 | Vitan et al. | |

FOREIGN PATENT DOCUMENTS

| | | | |
|---|---|---|---|
| DE | 34 42 194 | | 5/1986 |
| DE | 40 00 378 | | 7/1991 |
| EP | 0 860 141 | A2 | 8/1998 |
| EP | 0 726 978 | B1 | 9/1998 |
| GB | 2214524 | | 6/1989 |
| JP | 60-034493 | * | 2/1985 |
| JP | 62-284696 | * | 12/1987 |
| JP | 01-178294 | * | 7/1989 |
| JP | 02-104393 | * | 4/1990 |
| JP | 04-187183 | * | 7/1992 |
| JP | 06-233894 | * | 8/1994 |
| JP | 07-108095 | * | 4/1995 |
| JP | 2001157795 | | 12/2000 |
| JP | 2003-326076 | * | 11/2003 |
| KR | 2005066520 | * | 6/2005 |

OTHER PUBLICATIONS

Official Office Action mailed Sep. 28, 2009, in U.S. Appl. No. 11/871,783, pp. 1-15.

European Patent Office 0 430 366 Jun. 1991.

U.S. Official Action mailed Apr. 22, 2010 in U.S. Appl. No. 11/871,726, pp. 1-16.

U.S. Official Action mailed May 26, 2010 in U.S. Appl. No. 11/871,783, pp. 1-9.

* cited by examiner

BULK DISPENSE USER ADJUSTABLE CONTROLS

CROSS-REFERENCE TO RELATED APPLICATIONS

The present application is related to U.S. patent application having Ser. No. 11/871,726 titled "Multiple Compartments Wash Additives Auto-Dispenser in Washer or Dryer Pedestal" filed Oct. 12, 2007 and U.S. patent application having Ser. No. 11/871,783 titled "Removable Tank for Laundry Bulk Dispenser System" filed Oct. 12, 2007 which are hereby incorporated by reference in their entirety.

FIELD OF INVENTION

Embodiments of the present invention generally relate to additive delivery systems. More specifically, embodiments of the present invention relate to systems and methods for adjustable controls for bulk dispensers that deliver additives to an appliance (e.g. a washing machine and dryer).

BACKGROUND OF THE INVENTION

Many current systems for adding additives (e.g. soap, fabric softener, etc.) to an appliance (e.g. washing machine, dryer, etc.) are not adjustable. A user is only able to deliver an additive at the start of a cycle and in fixed amounts. If the user wishes to add additional additives, the user must add them during the cycle manually. In addition, these current systems for adding additives do not allow for user programming.

Having the above problems in mind, there exist a need for systems and methods for providing adjustable additive controls. The systems and methods should allow the user to customize operation of the appliance by allowing the user to customize when, how much, how often and what additives will be added during a cycle and at what times during the cycles the additives will be added.

BRIEF DESCRIPTION OF THE INVENTION

Consistent with embodiments of the present invention, systems for delivering at least one additive to an appliance are disclosed. The systems may include a user interface configured to accept a user input and a controller connected to the user interface. The controller may be configured to receive the user input and cause an additive delivery system to deliver at least one additive to the appliance.

Still consistent with embodiments of the present invention, systems for controlling an additive delivery system are disclosed. The systems may include a memory storage and a processing unit. The processing unit may be operative to receive a user input and retrieve a preprogrammed routine from the memory storage. The preprogrammed routine may include commands. The processing unit may then send the commands to the additive delivery system. The commands may indicate what additive is to be delivered to an appliance and at what time during a cycle the additive is to be delivered.

Still consistent with embodiments of the present invention, methods for delivering an additive to an appliance are disclosed. The methods may include receiving an amount of the additive to be delivered to the appliance and receiving a time during a cycle at which the additive is to be delivered to the appliance. The methods may further include activating an additive delivery system to deliver the amount of the additive at the delivery time.

BRIEF DESCRIPTION OF THE FIGURES

Non-limiting and non-exhaustive embodiments are described with reference to the following figures, wherein like reference numerals refer to like parts throughout the various views unless otherwise specified.

GENERAL DESCRIPTION

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated. Throughout this specification a washing machine or a dryer may be used as an example appliance. However, it is contemplated that embodiments of the invention may be used with other appliances such as a dishwasher, refrigerator, trash compactor, ice machine, etc.

Embodiments of the present invention utilize a controller to control additive delivery to an appliance. The controller may allow a user to input custom programs or select preloaded programs. In addition, the controller may allow the user to select from various tanks within an additive delivery system from which to draw additive.

The preloaded programs may indicate a type of cycle. For example, one of the preloaded programs may indicate that a washing machine is going to be used to wash towels. The program, whether custom or preloaded, contains instructions which cause the additive delivery system to deliver a certain amount of additive at a certain time during a cycle. In addition, the program may cause the additive delivery system to deliver more than one additive at various times throughout the cycle. In addition, the program may cause the additive delivery system to deliver one additive at multiple times throughout the cycle. Furthermore, the program may be changed to dispense different quantities of additive based on known and inputted concentrations of the additive.

Other aspects of the invention may include having the controller receive various parameters associated with the cycle and adjust the amount of and the time the additive is added. For example, in one aspect of the invention, the controller may receive the weight of a load of laundry and adjust the amount of additive to be added based on the weight. In another aspect of the invention, the controller may receive data representative of a water hardness of incoming water and adjust the additive amount based on the water hardness. In another aspect of the invention, the controller may receive data representative of a soil level of a load of laundry and adjust the additive amount based on the soil level.

DETAILED DESCRIPTION

Figure 1:
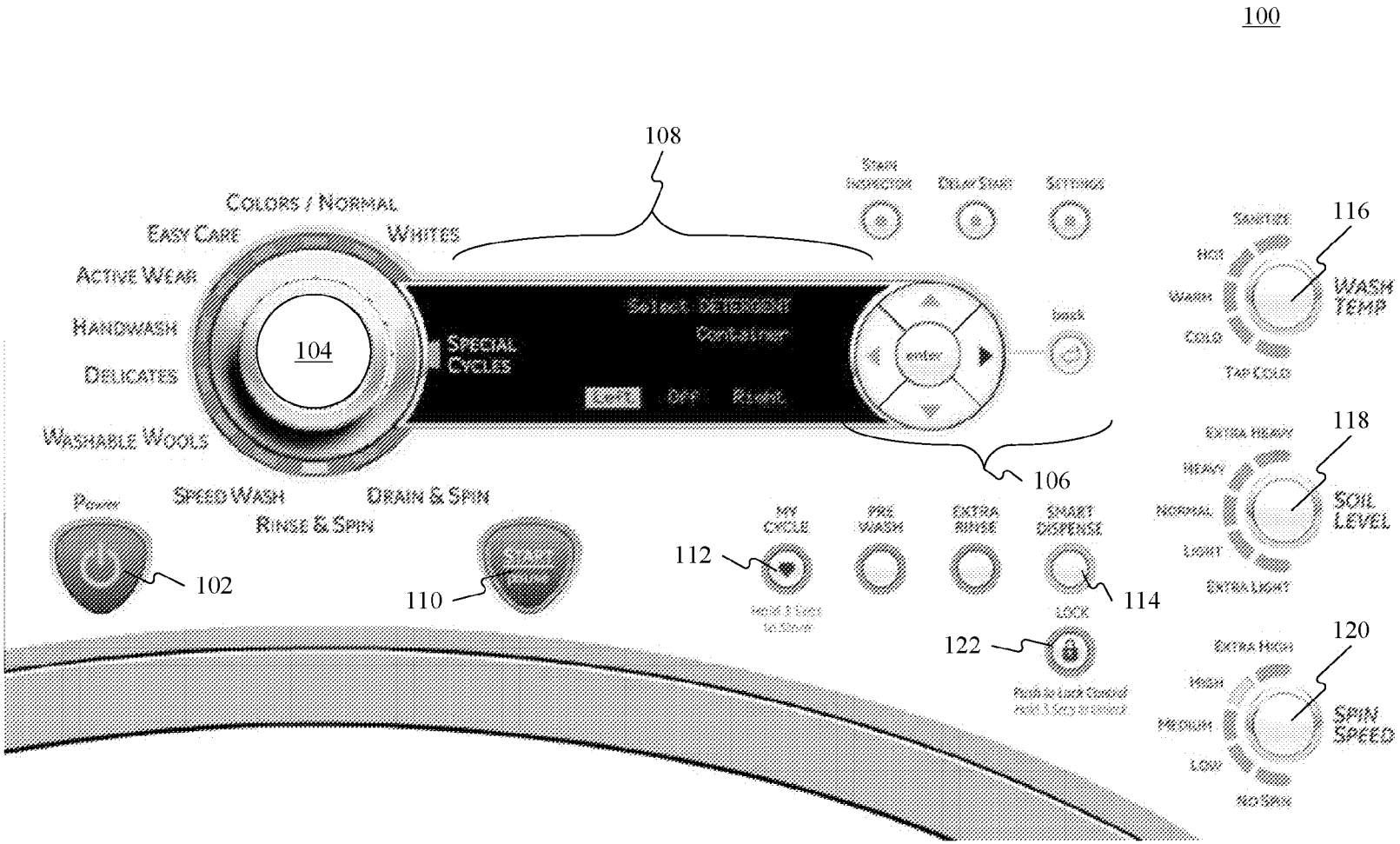
FIG. 1 depicts a control interface consistent with embodiments of the invention.

Referring now to the figures, FIG. 1 depicts a control interface 100 consistent with embodiments of the invention. The control interface 100 includes a power button 102, a dial 104, a display 108, programming buttons 106, a start/pause button 110, a My Cycle button 112, and a smart dispense button 114. In addition, the control interface 100 may include buttons 116, 118, and 120 for operating the appliance without using an additive delivery system. Furthermore, control interface 100 may include additional buttons for use in programming an additive delivery system 204 (See FIG. 2) and otherwise controlling functional operation of the appliance.

Figure 2:
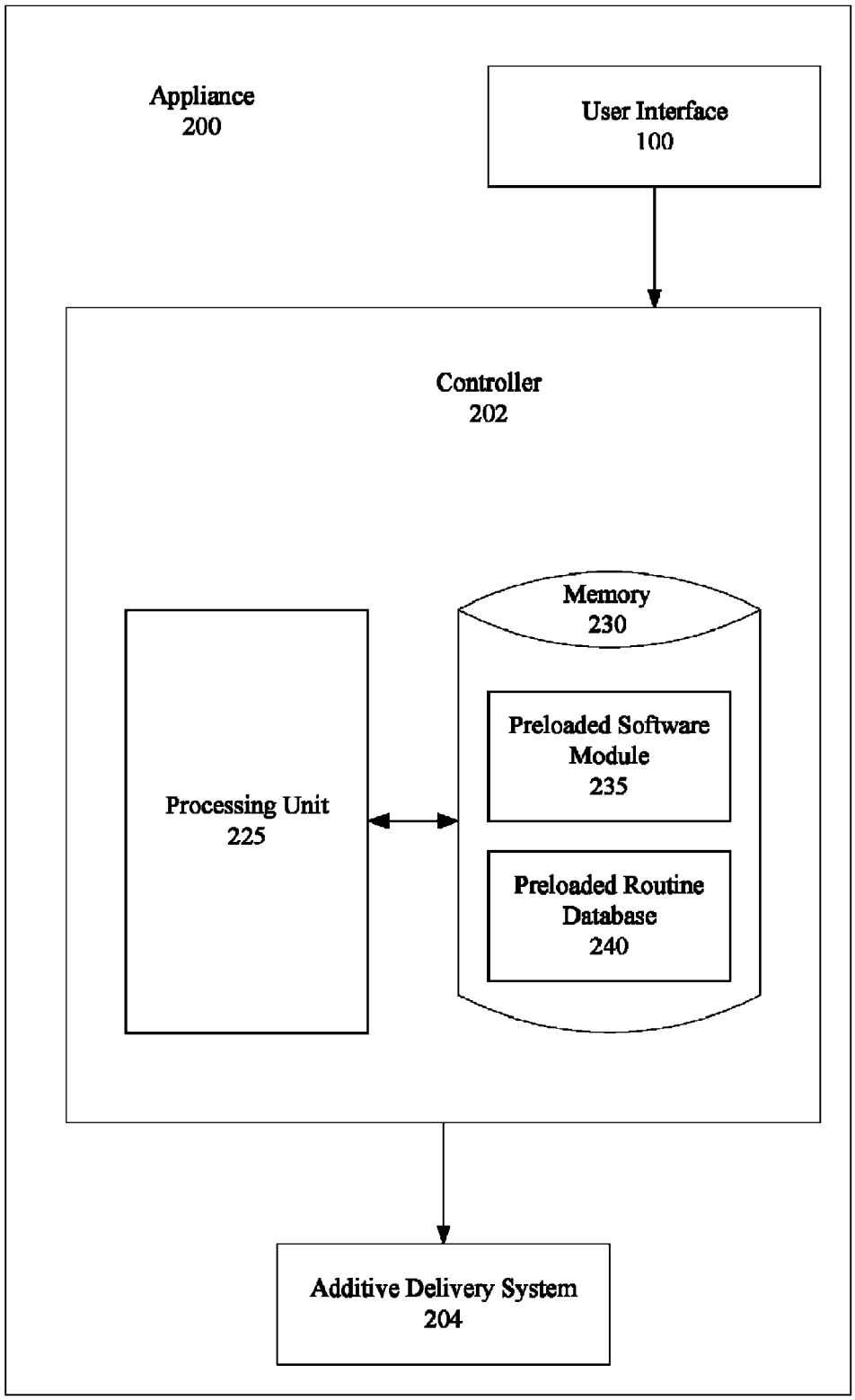
FIG. 2 depicts a block diagram of an appliance having additive delivery system.

Turning now to FIG. 2, FIG. 2 shows a block diagram of an appliance 200 having an additive delivery system 204 in more detail. The additive delivery control system 204 may include controller interface 100 of FIG. 1. As shown in FIG. 2, controller 202 includes a processing unit 225 and a memory 230. Memory 230 may include a preloaded software module 235 and preload routine database 240. While executing on processing unit 225, preloaded software module 235 performs processes for controlling the overall operation of the additive delivery system 204 and the appliance 200.

In addition to utilizing a wire line communications system, a wireless communications system, or a combination of wire line and wireless may be utilized in order to, for example, exchange information between controller interface 100, controller 202, and additive delivery system 204. Furthermore, web pages and the Internet may be utilized as communications channels between controller interface 100, controller 202, and additive delivery system 204. Wireless may be defined as radio transmissions via the airwaves. However, it may be appreciated that various other communication techniques can be used to provide wireless transmission, including infrared line of sight, cellular, and microwave. Wireless data may include, but is not limited to, paging, text messaging, e-mail, Internet access and other specialized data applications. For example, the processor may communicate across a wireless interface such as a handheld PDA interface, a wireless local area network interface (e.g., WLAN, IEEE 802), a BLUETOOTH interface, another RF communication interface, and/or an optical interface.

The wireless and wired communications may be used to allow the appliance to communicate information to a user, a home automation system, or other appliances. For example, if the appliance is a washing machine having an additive delivery system, a wireless communication may be used to send a text message to a user alerting them that a load of laundry has finished being washed or a desired additive storage tank is empty. Another example might entail having an additive delivery system and appliance communicate with a water softening system to obtain water hardness readings. Yet another example might entail having an appliance with an additive delivery system (e.g. a pool having an additive delivery system for delivery chemicals to the pool) communicate with a home automation system. This type of setup may allow the user to control the pool additive delivery system and monitor its operation while away from home via a webpage.

Figure 3:
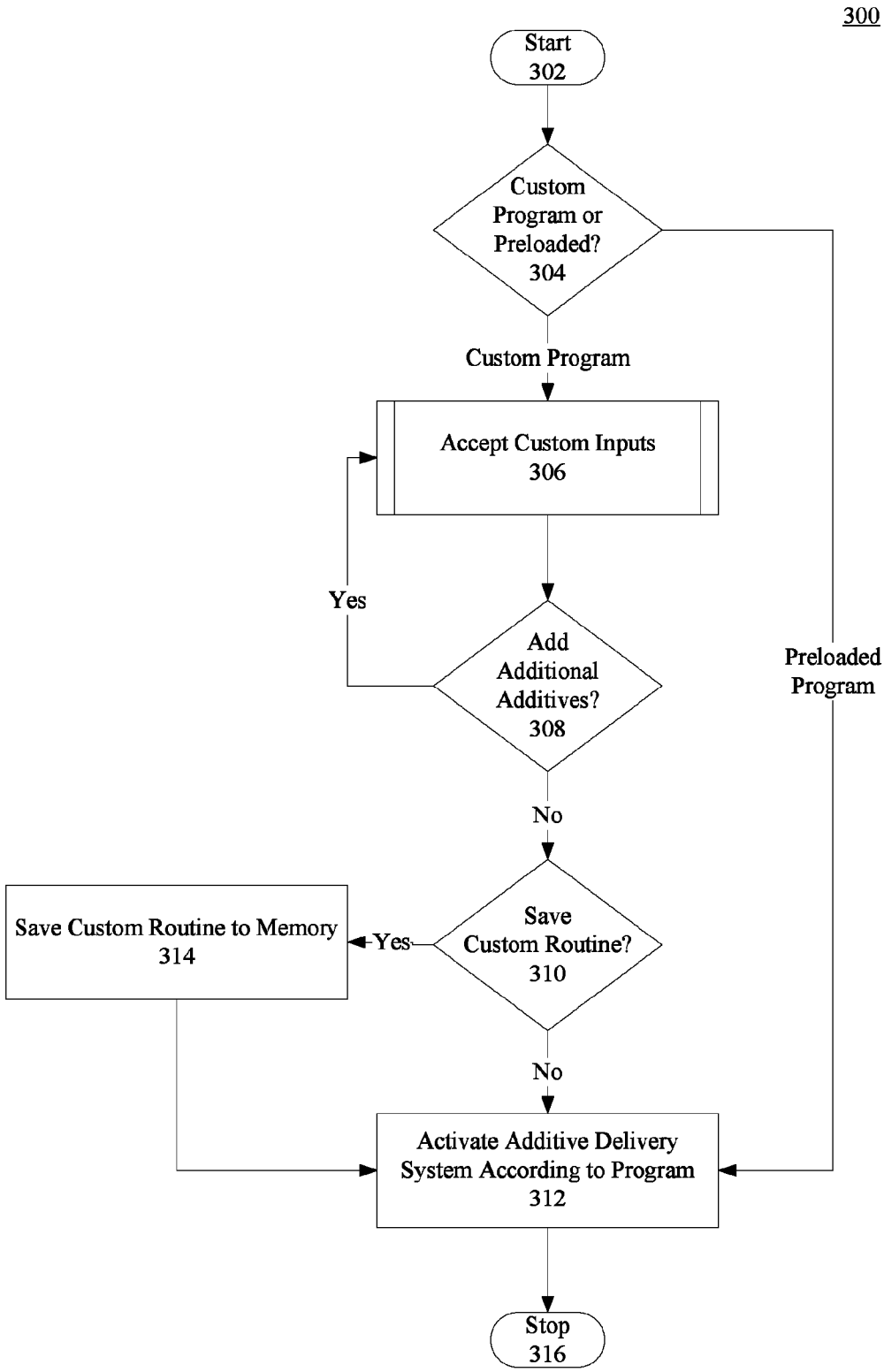
FIG. 3 depicts a flow chart of a method for controlling an additive delivery system.

Now referencing FIG. 3, FIG. 3 depicts a flow chart of a method 300 for controlling additive delivery system 204. Method 300 may be implemented using a controller 202 as described in more detail above with respect to FIG. 2. Ways to implement the stages of method 300 will be described as if the invention is being used in a washing machine. Method 300 may begin at starting block 302 and proceed to stage 304 where controller 202 may receive a custom program or retrieve a preloaded routine from preloaded program routine 240. From stage 304, when controller 202 receives a preloaded routine, method 300 may advance to stage 310 where controller 202 may activate additive delivery system 204 as defined by the preloaded routine.

Preloaded routines may contain instructions for controlling additive delivery system 204. For example, a preloaded routine may define at what time during a wash cycle a first additive is to be added and how much of the first additive (e.g. washing detergent) is to be added. In addition, the preloaded routine may define that the first additive is to be added to the cycle at a second time, or any multiple of times during the cycle. Moreover, the preloaded routine may define that the first additive is in a concentrated form and decrease the dosage amount appropriately. In addition, the preloaded routine may define that a second additive (e.g. fabric softener) is to be added to the cycle at a second time. Furthermore, the preloaded routine may indicate which storage tank, in a multi-tank additive delivery system, that the first and second additives are stored and should be drawn from. While a two storage tank system has been described, it is contemplated that a multi-tank additive delivery system may include any number of storage tanks and the storage tanks may be of varying sizes and house various additives.

In various aspects of the invention, preloaded program routine 240 may include additive delivery routines loaded during manufacturing or custom routines previously programmed and stored by the user. By way of example and not limitation, preloaded routine database 240 may include a bath load, a bedding load, a garment load, a pet bedding load, an energy saver load, and an athletic load. The name of the routine may indicate the type of items to be washed, the number of times the items are to be washed, an special additives that may need to be added during the wash, etc.

For example, the bath load routine may indicate that the items to be washed are items found in a bathroom (e.g. towels, wash cloths, bath rugs, shower curtains, etc.). The bedding load may indicate that sheets, pillows, pillow cases, comforters, etc. are being washed. In addition, for a bedding load, fabric softener or other additives may be added. A garment load may be delicate garment such as items made from silk or other delicate fabrics. Including but not limited to, a garment load may also indicate jeans, t-shirts, outdoor clothing, winter clothing, etc.

A pet bedding load may indicate that items used to care for pets are to be washed. For example, a pet bedding load may indicate that a pillow used in a dog's bed or towels used to bathe and dry a dog are to be washed. An athletic load may mean gym clothing or other clothing in which the wearer may sweat a lot. The idea is that for certain types of loads, such as pet beddings and athletic gear, extra detergent may be needed or the items may need to be to be washed more than once for a thorough cleaning.

An energy saver load may indicate that only a partial load is being washed. In other aspects of the invention, an energy saver load may indicate that the clothes are to be washed at a particular time of day. For example, during the summer months, an energy saver routine may cause the washing machine to cycle at night or other times of low energy consumption.

From stage 304, when controller 202 receives a custom routine, method 300 may advance to sub-stage 306 where controller 202 may accept custom inputs. The custom inputs may include the additive to be added, the storage tank from which the additive is to be drawn, and the time when the additive is to be added. Sub-stage 306 will be described in greater detail with respect to FIG. 4 below.

From sub-stage 306, where controller 202 accepts custom inputs, method 300 may advance to stage 308 where controller 202 may accept that additional additives are desired for the custom routine. For example, the user may be programming a custom routine and desire the first additive to be detergent and wishes to add a second additive (e.g. fabric softener). If the user wishes to add additional additives, method 300 may advance to sub-stage 306 where controller 202 may accept additional custom inputs.

The addition of additional additives may occur any number of times and the additional additives may be the same additive. In one aspect of the invention, the user may wish to add detergent at the beginning of the wash cycle and at a later time during the wash cycle. The additional amounts of detergent added may vary or be equal. In another aspect of the invention, the user may wish to continuously add an additive during the wash cycle. The permutation of number and amounts of an additive added and the time when the additions are made is limitless.

From stage 308, where controller 202 receives and indication that no additional additives are desired, method 300 may advance to stage 310 where controller 202 may allow the user to save the custom routine in stage 310. If the user desires to save their custom routine, then method 300 may advance to stage 314 where the user saves their custom routine to memory 230 for use at a later date. For example, the user may wish to have a custom bedding routine that differs from a bedding routine preloaded during manufacturing and stored in the preloaded routine database 240. The user may input their custom bedding routine, and access the routine from memory 230.

From stage 310 where the user chooses not to save their custom routine or from stage 314 where the user chooses to save their custom routine, method 300 may advance to stage 312 where controller 202 may activate additive delivery system 204 in accordance with the custom routine or preloaded routine. For example, the user may select the bath routine and controller 202 may activate additive delivery system 204 during washing of towels. Once controller 202 activates additive delivery system 204 in accordance with the custom routine or preloaded routine in stage 312, method 300 may then end at stage 316.

Figure 4:
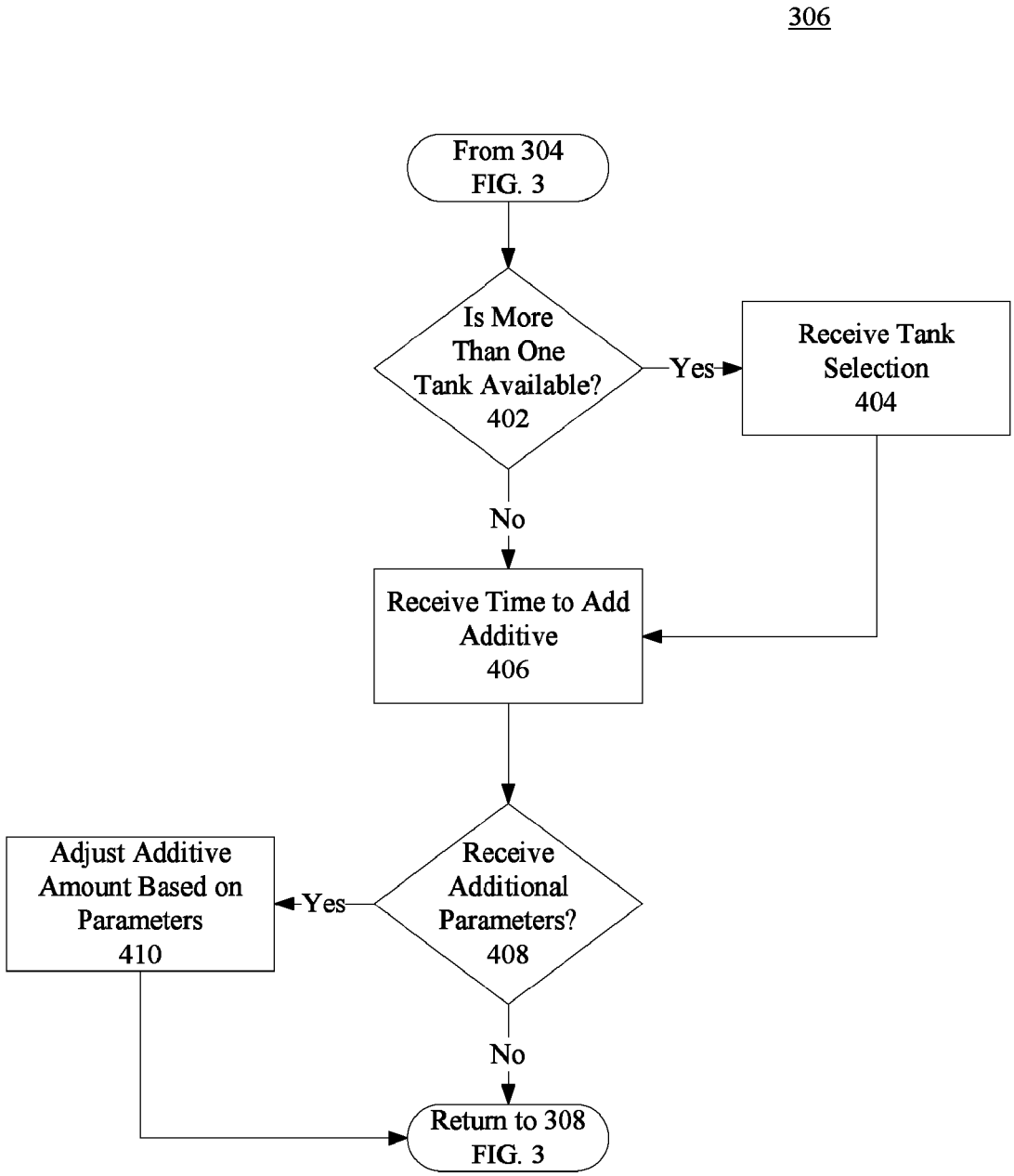
FIG. 4 depicts is a flow chart of a subroutine that may be used in the method of FIG. 3 for controlling the additive delivery system.

Turning now to FIG. 4, FIG. 4 depicts a process flow within a sub-stage 306 that may be used in the method of FIG. 3 for controlling the additive delivery system. Sub-stage 306 may begin at stage 402 where controller 202 may accept an input to determine if more than one storage tank is available from which to draw additives. From stage 402, when controller 202 receives an indication that more than one storage tank is available, sub-stage 306 may advance to stage 404 where controller 202 may receive a tank selection corresponding to which storage tank the additive is stored. If only one tank is present, the tank selection may default to the present tank.

For example, if additive delivery system 204 contains two storage tanks, each with a different detergent, the user may select which detergent will be used by selecting the storage tank in which it is stored. In other aspects of the invention, additive delivery system 204 may have a first storage tank housing a first additive (e.g. detergent) and a second storage tank housing a second additive (e.g. fabric softener). In this instance, receiving a tank selection may entail receiving a first tank selection indicating the first storage tank housing the first additive and receiving a second tank selection indicating the second storage tank housing the second additive.

In addition, controller 202 may receive indications from sensors indicating the presence and absence of storage tanks. For example, if additive delivery system 204 is capable of containing three storage tanks and the second storage tank is missing, controller 202 may provide an indication on display 108 altering the user that the second storage tank is missing. Furthermore, controller 202 may utilize the indication for the sensors to prohibit the user from selecting a storage tank that is absent.

Once controller 202 has defaulted to a single storage tank or received a tank selection in stage 404, sub-stage 306 may continue to stage 406 where controller 202 may receive a time to add the additive. In one aspect of the invention, the received time to add the additive may be at the beginning of the wash cycle. In another aspect of the invention, controller 202 may receive a first time indicating that a first additive is to be added at the beginning of the wash cycle and a second time indicating that a second additive is to be added during the cycle. For example, the first time may indicate that detergent is to be added at the beginning of the wash cycle and fabric softener is to be added at a later time during the wash cycle.

After controller 202 has received a time to add the additive in stage 406, sub-stage 306 may proceed to stage 408 where controller 202 may receive additional parameters. Additional parameters may include parameters which may affect the performance of the appliance including but not limited too, water hardness of incoming water, weight of article(s) in the appliance, a soil level for the article(s), concentration of the additive, etc. For example, controller 202 may receive the soil level indicating the load of laundry is very dirty (i.e. clothing worn while doing landscaping) and increase or decrease the dosage of additive delivered based on the soil level. In addition, the amount of agitation may be adjusted based on the soil level. For instance, clothing worn while doing landscaping may receive additional and more vigorous agitation then gym clothing.

For example, controller 202 may receive a water hardness indicating the hardness of the water being delivered to the washing machine for use during the cycle. Controller 202 may then adjust the amount of the additive being delivered to the appliance in response to the water hardness. In addition, controller 202 may receive a load weight measurement indicating the weight of a load of laundry. Controller 202 may then adjust the amount of the additive delivered to the washing machine in response to the load weight measurement. Furthermore, controller 202 may receive a soil indicator indicating how dirty a load of laundry is and adjust the amount of the additive delivered to the washing machine based on the soil indicator. It is contemplated that controller 202 may receive more than one additional parameter. For example, controller 202 may receive data representative of a load weight measurement and water hardness and adjust the amount of additive delivered to the washing machine accordingly.

After controller 202 adjust the amount of additive to be added based on the additional parameters in stage 410 or determines that no additional parameter have been received, sub-stage 306 may then proceed to return to stage 308 from FIG. 3.

An example implementation of controlling additive delivery system 204 may proceed as follows. A user may activate controller 202 and additive delivery system 204 by pressing power button 102. Next, the user may select a preloaded routine by selecting a "special cycle" as displayed on display 108 using dial 104 and programming buttons 106 or pressing "my cycle" button 112 to load a custom routine.

To program a custom routine, the user may press the "smart dispense" button 114. Upon pressing the smart dispense button 114, display 108 may prompt the user to select a left or right detergent container. The user may utilize the directional control programming buttons 106 (i.e. the buttons with the arrows on them) to highlight the left tank and may confirm their selection by pressing the "enter" button.

After selecting the detergent tank, the user may be prompted to select a concentration level. Again, the concentration level may be selected utilizing the directional control buttons and enter button from programming buttons 106. After selecting the concentration level, the user may be asked to select a fabric softener tank. Once the user has programmed their custom routine, they may save their custom routine by depressing my cycle button 112 for three seconds and start the wash cycle by pressing start/pause button 110.

Controller 202 may be further configured to perform diagnostic tests and provide the user with feedback as to how the appliance is operating. For example, controller 202 may receive indications as to how much additive is stored in each storage tank from sensors located within the storage tanks. Controller 202 may then display this information to the user via display 108. In addition, controller 202 may be configured to alert the user when they are about to execute a program that requires more additive than is in a selected storage tank. For example, controller 202 may alert the user when they wish to add a half cup of fabric softener from a first storage tank, but there is less than a half cup of fabric softener in the first storage tank.

In addition, controller 202 may be further configured to prime the delivery lines of additive delivery system 204 at various times during a cycle. For instance, controller 202 may prime the delivery lines during a startup routine. Furthermore, controller 202 may also purge fluids from the delivery lines during the cycle. For example, at the beginning of the cycle, controller 202 may deliver a first additive and before delivering a second additive, controller 202 may purge the first additive from the delivery lines. Moreover, controller 202 may prime the delivery lines at various times during a cycle and at various times as a self-clean cycle to clean the additive delivery system 204. For example, controller 202 may run the self-clean cycle after every ten loads of laundry. In other aspects of the invention, controller 202 may run the self-clean cycle when the second additive to be added differs from the first additive delivered. For instance, controller 202 may run the self-clean cycle after delivering detergent but before delivering fabric softener.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A method for custom delivery of at least one additive to a household appliance including an additive delivery system, the method comprising:

receiving, by a controller, an input facilitating selection of an additive delivery program module that controls an amount of the at least one additive to be delivered to the household appliance;

wherein the program module selected, operative within the controller, facilitates automated functionality of the additive delivery system by defining timing and amount of the at least one additive to be delivered;

delivering, by the additive delivery system, the at least one additive in accordance with the amount and timing defined by the program module selected, wherein the amount and timing of delivery of the at least one additive are variable and set by the controller in response to the controller processing a mode of operation input and data representative of at least one of a plurality of measurements, including additive type, additive concentration and water hardness.

2. The method of claim 1, wherein delivery of the at least one additive may be in accordance with a customized program module which may be retrieved and implemented to activate and direct the additive deliver system to deliver the at least one additive according to the customized program module in response to the plurality of measurements processed.

3. The method of claim 1, wherein the plurality of measurements processed by the household appliance further include:

data representative of a load type.

4. The method of claim 3, wherein the load type comprises at least one of a bath load, a bedding load, a garment load, a pet bedding load, an energy saver load, and an athletic load.

5. The method of claim 1, wherein the program module selected further comprising selecting a tank wherein the tank selected identifies at least one tank in the additive delivery system from which the at least one additive is to be drawn.

6. The method of claim 1, wherein the program module selected causes the controller to generates a signal controlling:

distribution of a second amount of the at least one additive to be delivered to the household appliance and;

timing at which a second amount of the at least one additive is to be delivered at a second time to the household appliance.

7. The method of claim 6, wherein a communication system within the appliance is configured to communicate with the controller and generate messages for transmission to the to at least one of a user, a home automation system and another appliance.

8. The method of claim 1, wherein the communications system includes wireless capability for transmitting wireless messages comprising at least one of a paging message, text message and an e-mail further comprising delivering a second amount of the at least one additive at a second time during the cycle.

9. The method of claim 1, wherein the measurements processed by the household appliance further include:

a load weight measurement; and wherein the controller adjusts the amount of the at least one additive delivered to the household appliance in response to the load weight measurement.

10. The method of claim 9, wherein the controller adjusts the at least one time the at least one additive is delivered to the household appliance in response to the load weight measurement.

11. The method of claim 1, further comprising:

Receiving, by a controller, a soil level indicator data; and wherein the program module selected adjusts amount of the at least one additive to be delivered to the household appliance in response to the controller processing the soil level indicator data.

12. A apparatus for controlling delivery of additives to a household appliance, the apparatus comprising:

a memory storage;

an additive delivery system; and a controller coupled to the memory storage and the additive delivery system, wherein the controller is configured to:

receive input facilitating selection of an additive delivery program module that controls an amount of at least one additive to be delivered to the household appliance and timing of delivery of the amount of the at least one additive;

retrieve a preprogrammed routine from the memory storage, the preprogrammed routine including commands that facilitate automated functionality of the additive delivery system by defining timing and amount of the at least one additive to be delivered; and wherein the additive delivery system delivers the at lest on additive in accordance with the amount and timing defined by the program module selected, wherein the amount and timing of delivery of the at least one additive are variable and set by the controller in response to the controller processing a mode of operation input and data representative of at least one of a plurality of measurements, including additive type, additive concentration and water hardness.

13. The apparatus of claim 12, further comprising a communication system configured to communicate information regarding an appliance to at least one of a user, a home automation system and another appliance wherein the communications system is configured to communicate with the controller and generate messages for transmission to the to at least one of a user, a home automation system and another appliance.

14. The apparatus of claim 13, wherein the communications system includes wireless capability for transmitting wireless messages comprising at least one of a paging message, text message and an e-mail.

15. The apparatus of claim 12, wherein the controller is further configured to receive a tank selection, wherein the tank selection indicates a tank in the additive delivery system from which the at least one additive is to be drawn.

16. The apparatus of claim 12, wherein the controller may be further configured to:

receive a load weight measurement; and adjust the amount of the at least one additive defined by the user for delivery to the household appliance in response to the load weight measurement.

17. The apparatus of claim 12, wherein the controller is further configured to:

deliver a first additive of the at least one additive at a first time during the cycle; and deliver a second additive of the at least one additive at a second time during the cycle.

18. The apparatus of claim 12, wherein the controller is further configured to:

receive a water hardness indicator indicating the hardness of the water being delivered to the household appliance for use during the cycle; and adjust the amount of the at least one additive being delivered to the household appliance in response to the water hardness indicator.

19. The apparatus of claim 12, wherein the controller is further configured to:

receive a soil level; and adjust the amount of the at least one additive being delivered to the household appliance in response to the soil level.

20. The apparatus of claim 12, wherein the controller is further configured to cause the additive delivery system to purge delivery lines of the additive delivery system prior to delivering the at least one additive.

* * * * *

UNITED STATES PATENT AND TRADEMARK OFFICE

CERTIFICATE OF CORRECTION

PATENT NO. : 7,802,335 B2
APPLICATION NO. : 11/871750
DATED : September 28, 2010
INVENTOR(S) : Christopher Hoppe et al.

It is certified that error appears in the above-identified patent and that said Letters Patent is hereby corrected as shown below:

In the Claims

Column 8, Line 15 currently reads "...additive deliver system..." should read --...additive delivery system...--

Column 8, Line 42 currently reads "The method of claim 1...." should read --The method of claim 7--

Column 8, Lines 46-47 currently reads "...second time during the cycle." should read --...second time.--

Column 8, Line 55 currently reads "...the at least one time the at least one additive..." should read --at least one time the at least one additive...--

Column 8, Lines 54-55 currently reads "...adjusts the at least one time the at least one additive is delivered to..." should read --...adjusts at least one time the at least one additive delivered to...--

Column 8, Line 59 currently reads "Receiving, by a controller..." should read --receiving, by the controller...--

Column 10, Line 12 currently reads "...time during the cycle; and..." should read --...time; and...--

Column 10, Line 14 currently reads "...second time during the cycle." should read --...second time.--

Column 10, Line 19 currently reads "...for use during the cycle; and..." should read --...for use; and...--

Signed and Sealed this
Eighteenth Day of August, 2015

Michelle K. Lee

Michelle K. Lee
*Director of the United States Patent and Trademark Office*